US012146310B2

(12) United States Patent
Chen et al.

(10) Patent No.: US 12,146,310 B2
(45) Date of Patent: Nov. 19, 2024

(54) DRAIN VALVE

(71) Applicant: Kohler (China) Investment Co., Ltd., Shanghai (CN)

(72) Inventors: Youpeng Chen, Shanghai (CN); Congxian Huang, Shanghai (CN); Shutuan Liu, Shanghai (CN); Yunqing Zang, Shanghai (CN)

(73) Assignee: Kohler (China) Investment Co. Ltd., Shanghai (CN)

( * ) Notice: Subject to any disclaimer, the term of this patent is extended or adjusted under 35 U.S.C. 154(b) by 280 days.

(21) Appl. No.: 17/747,258

(22) Filed: May 18, 2022

(65) Prior Publication Data

US 2022/0381020 A1 Dec. 1, 2022

(30) Foreign Application Priority Data

May 25, 2021 (CN) ..... 202121137590.4

(51) Int. Cl.
*E03D 5/02* (2006.01)

(52) U.S. Cl.
CPC ..... *E03D 5/026* (2013.01)

(58) Field of Classification Search
CPC ..... E03D 5/026; E03D 1/34
See application file for complete search history.

(56) References Cited

U.S. PATENT DOCUMENTS 2,988,751 A * 6/1961 Rutherford ..... E03D 5/026 4/407

FOREIGN PATENT DOCUMENTS

| | | | | |
|---|---|---|---|---|
| EP | 1854926 A1 * | 11/2007 | ..... | E03D 1/34 |
| EP | 3128089 A1 * | 2/2017 | ..... | E03D 1/012 |
| WO | WO-2017212068 A2 * | 12/2017 | ..... | E03D 1/34 |

OTHER PUBLICATIONS

Extended European Search Report from European Patent Application No. 22174306.5, dated Oct. 20, 2022, 8 pages.

* cited by examiner

*Primary Examiner* — Christine J Skubinna
(74) *Attorney, Agent, or Firm* — Lempia Summerfield Katz LLC

(57) ABSTRACT

The present application discloses a drain valve, comprising a valve body, a valve seat, and an overflow pipe. The valve seat includes a drainage channel. The overflow pipe includes a blocking element and a flow rate regulator. When the overflow pipe is in a raised state, the blocking element leaves a channel water inlet, the flow rate regulator is partially or completely located above the channel water inlet, and a water flow channel is formed between the flow rate regulator and the channel water inlet. An amount of water entering the drainage channel from the channel water inlet in unit time can be defined by the flow rate regulator, and thus a drainage flow rate can be controlled. If a user needs to change the drainage flow rate, the user only replaces different types of flow rate regulators, without replacing the whole drain valve to save costs.

18 Claims, 8 Drawing Sheets

DRAIN VALVE

CROSS REFERENCE TO RELATED APPLICATION

This application claims the benefit of priority to Chinese Patent Application No. 202121137590.4 filed in the Chinese Intellectual Property Office on May 25, 2021, which is hereby incorporated by reference in its entirety.

FIELD

The present disclosure relates to the technical field of water tank of toilet, and more particularly, to a drain valve.

BACKGROUND

A drain valve is mounted in a water tank of a toilet. An overflow pipe is arranged in the drain valve, and the overflow pipe can be lifted or lowered to open or close a drainage channel in a valve seat. When the drain valve is opened, a predetermined amount of water may be drained from the water tank to meet a requirement of flushing the toilet. A spraying orifice in the toilet is fixed. If a drainage speed of the drain valve is fast, a flow rate of water sprayed by the toilet is also fast, thus a good flushing effect can be obtained. On the contrary, if the drainage speed of the drain valve is slow, the flow rate of water sprayed by the toilet is also slow, thus the flushing effect is poor.

In the prior art, the drainage speed of the drain valve cannot be regulated, and if a user needs to regulate the drainage speed, the user needs to replace different models of drain valves.

SUMMARY

The present disclosure aims to provide a drain valve, in which a flow rate regulator is arranged at a lower end of an overflow pipe to define a water flow channel allowing a water flow to pass through between the flow rate regulator and a channel water inlet. Thus, an amount of water entering a drainage channel from the channel water inlet in unit time can be defined, and thus a drainage rate can be controlled.

The technical solution of the present disclosure provides a drain valve, comprising a valve body, a valve seat mounted below the valve body, and an overflow pipe located in the valve body and capable of moving up and down.

The valve seat is provided with a drainage channel, the overflow pipe is provided with a blocking element, and the overflow pipe is also provided with a flow rate regulator below the blocking element.

The overflow pipe has an initial state and a raised state and is capable of switching a state between the initial state and the raised state.

When the overflow pipe is in the initial state, the blocking element seals a channel water inlet of the drainage channel, and the flow rate regulator is located in the drainage channel.

When the overflow pipe is in the raised state, the blocking element leaves the channel water inlet, the flow rate regulator is at least partially or completely located above the channel water inlet, and a water flow channel is formed between the flow rate regulator and the channel water inlet.

In one embodiment, a lower end of the overflow pipe is provided with a connector, and the flow rate regulator is clamped with the connector.

In one embodiment, the connector is provided with a clamping groove, the flow rate regulator is provided with a clamping claw, and the clamping claw is clamped with the clamping groove.

In one embodiment, the clamping groove is an annular clamping groove, a plurality of clamping claws are arranged on the flow rate regulator at intervals along a circumferential direction, and each clamping claw is clamped with the annular clamping groove.

In one embodiment, the flow rate regulator comprises an outer ring portion and an inner ring portion connected to the outer ring portion, and the clamping claw is arranged on the inner ring portion;

When the overflow pipe is in the raised state, the water flow channel is formed between the outer ring portion and the water inlet of the channel.

In one embodiment, a top surface of the outer ring portion is higher than a top surface of the clamping claw, and the top surface of the outer ring portion is contacted with a bottom portion of the overflow pipe.

In one embodiment, the flow rate regulator is a rubber part.

In one embodiment, the blocking element is a rubber gasket.

In one embodiment, a sealing ring is arranged in the drainage channel.

In one embodiment, the flow rate regulator comprises a plurality of replacement parts.

By adopting the above technical solutions, the present disclosure has the following beneficial effects.

According to the drain valve provided by the present disclosure, the flow rate regulator is arranged at a lower end of the overflow pipe to define the water flow channel allowing a water flow to pass through between the flow rate regulator and the channel water inlet. Thus, an amount of water entering the drainage channel from the channel water inlet in unit time can be defined, and thus a drainage speed can be controlled. If a user needs to change the drainage speed, the user only needs to replace different models of flow rate regulators, without replacing the whole drain valve to save costs.

According to the drain valve provided by the present disclosure, the flow rate regulator is mounted in a clamping mode, and thus it is convenient to replace the flow rate regulator.

According to the drain valve provided by the present disclosure, the flow rate regulator is equipped with different models of replacement parts, and thus the user may replace different models of flow rate regulators as required to meet the user's demand for a drainage speed.

DETAILED DESCRIPTION

Figure 1:
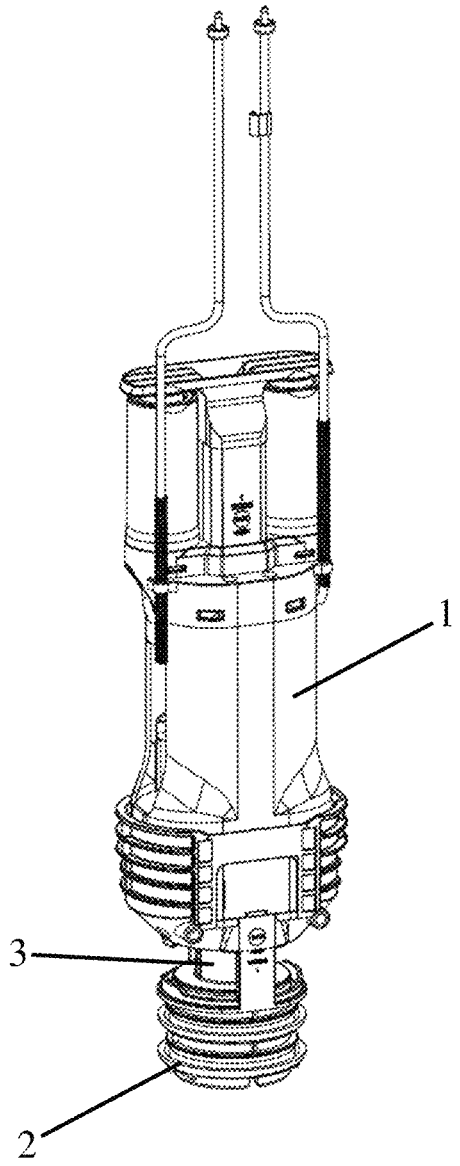
FIG. 1 is a perspective view of a drain valve provided by an embodiment of the present disclosure.

The specific implementations of the present disclosure are further described hereinafter with reference to the drawings. The same or equivalent parts are denoted by the same reference numerals. It should be noted that the terms "front", "back", "left", "right", "up", and "down" used in the following description refer to the directions in the drawings, and the terms "inner" and "outer" refer to the directions toward or away from geometric centers of specific parts respectively.

Figure 2:
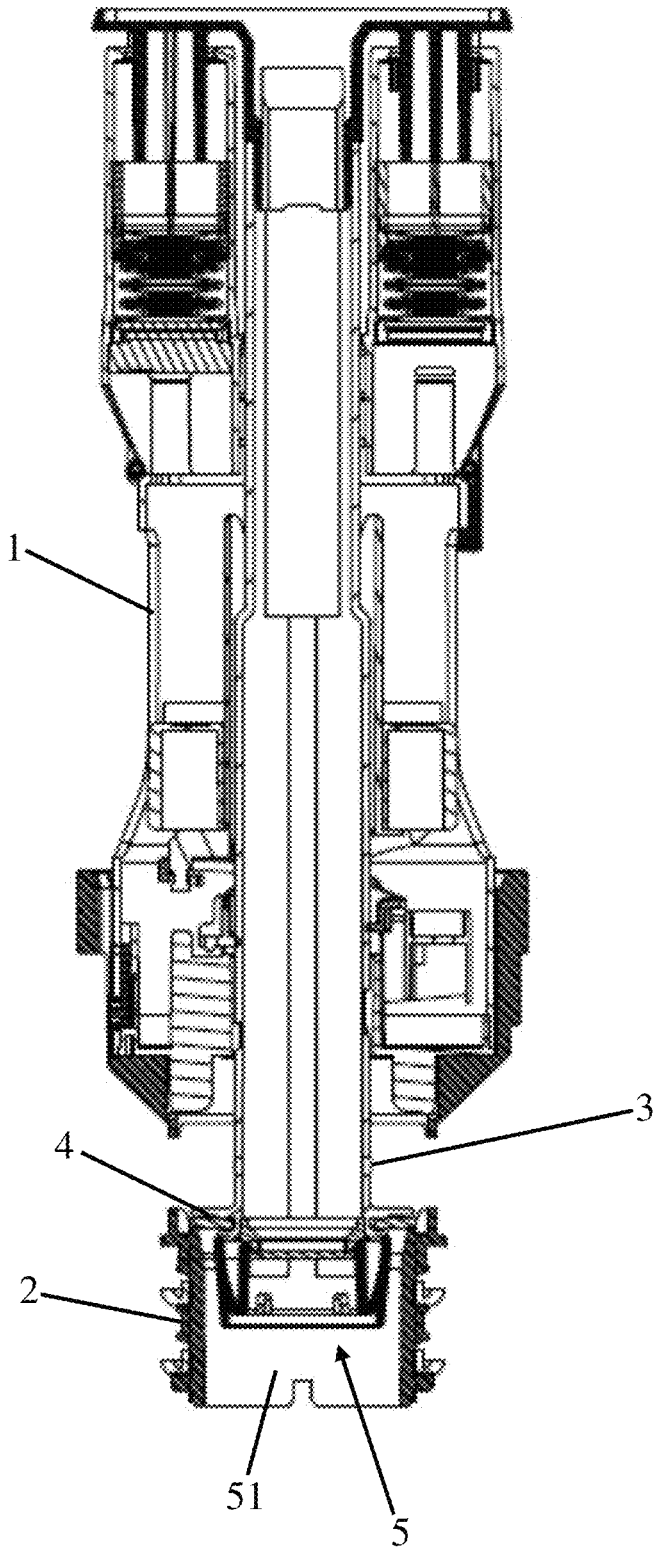
FIG. 2 is a cross-sectional view of the drain valve provided by the embodiment of the present disclosure.
Figure 3:
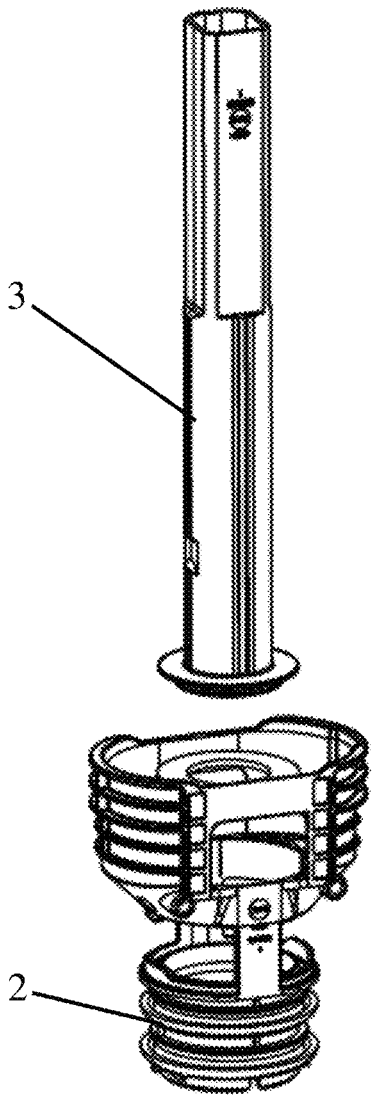
FIG. 3 is an exploded view of an overflow pipe and a valve seat.
Figure 6:
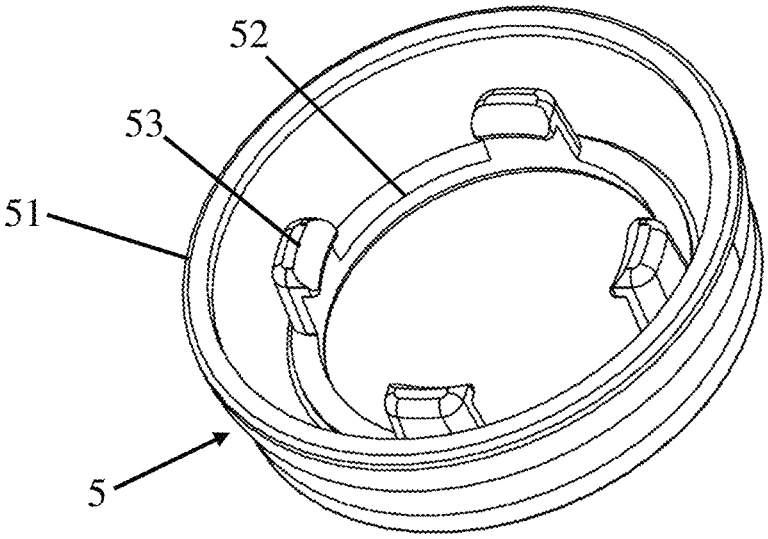
FIG. 6 is a perspective view of one type of flow rate regulator.
Figure 7:
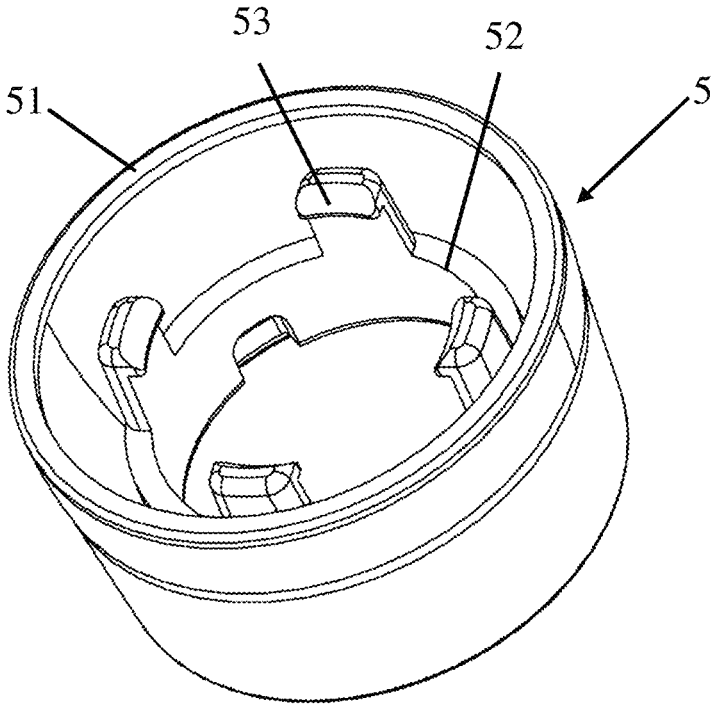
FIG. 7 is a perspective view of another type of flow rate regulator.
Figure 8:
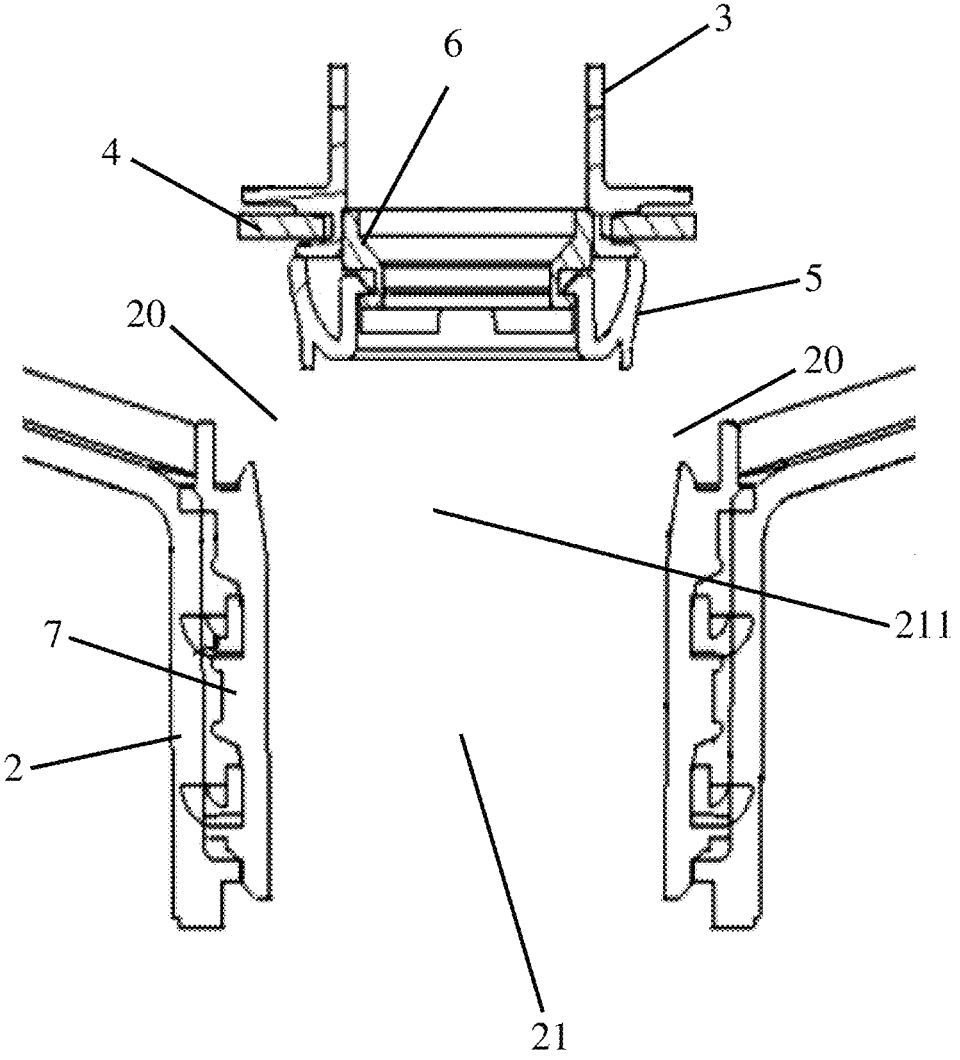
FIG. 8 is a schematic diagram of forming a water flow channel between the flow rate regulator and a channel water inlet when the flow rate regulator shown in FIG. 6 is adopted.
Figure 9:
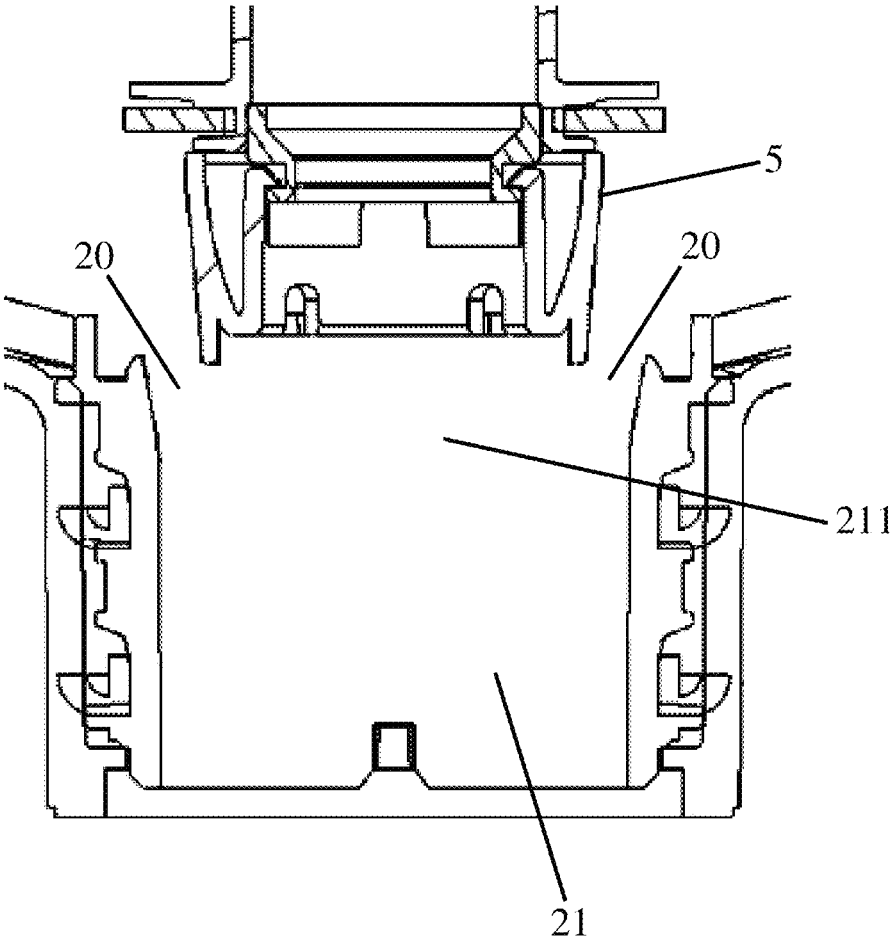
FIG. 9 is a schematic diagram of forming the water flow channel between the flow rate regulator and the channel water inlet when the flow rate regulator shown in FIG. 7 is adopted.

FIG. 1 is a perspective view of a drain valve provided by an embodiment of the present disclosure. FIG. 2 is a cross-sectional view of the drain valve provided by the embodiment of the present disclosure. FIG. 3 is an exploded view of an overflow pipe and a valve seat. FIG. 6 is a perspective view of one type of flow rate regulator. FIG. 7 is a perspective view of another type of flow rate regulator. FIG. 8 is a schematic diagram of forming a water flow channel between the flow rate regulator and a channel water inlet when the flow rate regulator shown in FIG. 6 is adopted. FIG. 9 is a schematic diagram of forming the water flow channel between the flow rate regulator and the channel water inlet when the flow rate regulator shown in FIG. 7 is adopted. As shown in FIG. 1 to FIG. 3 and FIG. 6 to FIG. 9, a drain valve provided by an embodiment of the present disclosure comprises a valve body 1, a valve seat 2 mounted below the valve body 1, and an overflow pipe 3 located in the valve body 1 and capable of moving up and down.

The valve seat 2 is provided with a drainage channel 21, and the overflow pipe 3 is provided with a blocking element 4. The overflow pipe 3 is also provided with a flow rate regulator 5 below the blocking element 4.

The overflow pipe 3 has an initial state and a raised state and is capable of switching a state between the initial state and the raised state.

When the overflow pipe 3 is in the initial state, the blocking element 4 seals a channel water inlet 211 of the drainage channel 21, and the flow rate regulator 5 is located in the drainage channel 21.

When the overflow pipe 3 is in the raised state, the blocking element 4 leaves the channel water inlet 211, the flow rate regulator 5 is at least partially or completely located above the channel water inlet 211, and a water flow channel 20 is formed between the flow rate regulator 5 and the channel water inlet 211.

The drain valve provided by the present disclosure is used in a water tank of a toilet. The drain valve comprises the valve body 1, the valve seat 2, the overflow pipe 3, etc. The valve seat 2 is connected to a lower end of the valve body 1. The valve seat 2 is provided with the drainage channel 21 for draining water in the water tank. The overflow pipe 3 is assembled in the valve body 1, and capable of moving up and down relative to the valve body 1. A lower portion of the overflow pipe 3 is provided with the blocking element 4. When the overflow pipe 3 is in the initial state, the blocking element 4 covers the channel water inlet 211 of the drainage channel 21, and thus the drainage channel 21 is closed. When the overflow pipe 3 is lifted up, the blocking element 4 leaves the channel water inlet 211, and thus water may be drained from the drainage channel 21. The drain valve may be a connecting-rod drain valve or a pneumatic drain valve. A structure and lifting and lowering modes of related overflow pipe have been omitted herein.

In order to control an amount or flow rate of water entering the drainage channel 21, the flow rate regulator 5 is arranged at the lower end of the overflow pipe 3, and the flow rate regulator 5 is located below the blocking element 4.

When the overflow pipe 3 is in the initial state, the flow rate regulator 5 is completely located in the drainage channel 21.

When the overflow pipe 3 is in the raised state, the flow rate regulator 5 is partially or completely located above the channel water inlet 211, and thus the water flow channel 20 is defined and formed between the flow rate regulator 5 and the channel water inlet 211. Water in the water tank enters the channel water inlet 211 through the water flow channel 20 and then is drained through the drainage channel 21. The water flow channel 20 determines the amount of water entering the drainage channel 21 from the channel water inlet 211 in unit time, so that the drainage speed can be controlled. If an opening area of the water flow channel 20 is large, an amount of flowing water in unit time is large, and the drainage speed is fast. If the opening area of the water flow channel 20 is small, the amount of flowing water in unit time is small, and the drainage speed is slow. If a user needs to change the drainage speed, the user only needs to replace different models of flow rate regulators 5, without replacing the whole drain valve. Thus, the costs for the replacement may be saved.

Figure 4:
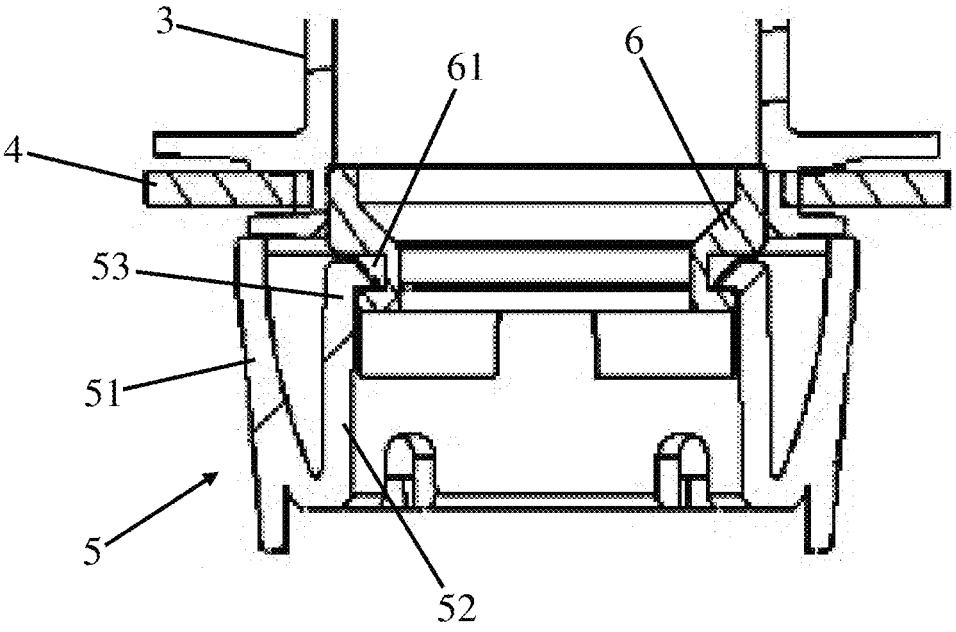
FIG. 4 is a cross-sectional view of the overflow pipe, a blocking element, a connector and a flow rate regulator assembled together.

FIG. 4 is a cross-sectional view of the overflow pipe, a blocking element, a connector and a flow rate regulator assembled together. In one embodiment, as shown in FIG. 4, a lower end of the overflow pipe 3 is provided with a connector 6, and the flow rate regulator 5 is clamped with the connector 6. The connector 6 is assembled at the lower end of the overflow pipe 3. The connector 6 may be assembled at the lower end of the overflow pipe 3 by a pin or connected to the lower end of the overflow pipe 3 through a thread. The flow rate regulator 5 is clamped with the connector 6 through a clamping structure to facilitate disassembly and assembly of the flow rate regulator 5. The clamping structure may be a clamping groove or a clamping claw, etc.

In one embodiment, as shown in FIG. 4, FIG. 6, and FIG. 7, the connector 6 is provided with the clamping groove 61, the flow rate regulator 5 is provided with the clamping claw 53, and the clamping claw 53 is clamped with the clamping groove 61.

In the embodiment, the clamping groove 61 is arranged on an outer peripheral surface of the connector 6, and the clamping claw 53 is integrally arranged on the flow rate regulator 5. During assembly, the clamping claw 53 is clamped into the clamping groove 61. During disassembly, the clamping claw 53 is removed from the clamping groove 61.

In one embodiment, the clamping groove 61 is an annular clamping groove, a plurality of clamping claws 53 are arranged on the flow rate regulator 5 at intervals along a circumferential direction of the flow rate regulator 5, and each clamping claw 53 is clamped with the annular clamping groove 61. Thus, the connection stability between the flow rate regulator 5 and the connector 6 may be improved.

In one embodiment, as shown in FIG. 4, FIG. 6, and FIG. 7, the flow rate regulator 5 comprises an outer ring portion 51 and an inner ring portion 52 connected in the outer ring portion 51, and the clamping claw 53 is arranged on the inner ring portion 52.

When the overflow pipe 3 is in the raised state, the water flow channel 20 is formed between the outer ring portion 51 and the channel water inlet 211.

In the embodiment, the flow rate regulator 5 has a two-layer structure including an inner layer and an outer layer, the outer ring portion 51 is higher than the inner ring portion 52, a bottom portion of the outer ring portion 51 is connected with a bottom portion of the inner ring portion 52, and the clamping claw 53 is integrally arranged at a top portion of the inner ring portion 52. After assembly, the inner ring portion 52 mainly bears an acting force produced when the clamping claw 53 is clamped. The outer ring portion 51 is used for defining a contour of the water flow channel 20. When the overflow pipe 3 is in the raised state, the water flow channel 20 is formed between the outer ring portion 51 and the channel water inlet 211. A size and a shape of the water flow channel 20 may be changed by changing a size, a shape, and/or a contour of the outer ring portion 51.

In one embodiment, as shown in FIG. 4, FIG. 6, and FIG. 7, a top surface of the outer ring portion 51 is higher than a top surface of the clamping claw 53, and the top surface of the outer ring portion 51 is contacted with a bottom portion of the overflow pipe 3. Thus, a sealing effect to prevent water from entering a concave cavity between the inner ring portion 52 and the outer ring portion 51 may be achieved.

In one embodiment, the flow rate regulator 5 is a rubber part with a good elasticity, and thus it is convenient to assembly and disassembly the flow rate regulator 5.

In one embodiment, the blocking element 4 is a rubber gasket with a good elasticity, and thus a good sealing effect may be obtained.

In one embodiment, as shown in FIG. 8, a sealing ring 7 is arranged in the drainage channel 21. When the overflow pipe 3 is in the initial state, the flow rate regulator 5 is located in the sealing ring 7, and the blocking element 4 is hermetically contacted with a top portion of the sealing ring 7. Thus, a sealing performance may be improved when the drain valve is closed.

Figure 5:
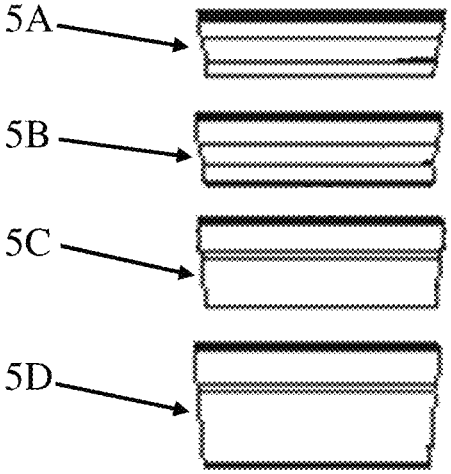
FIG. 5 is a schematic diagram of four types of replacement parts of the flow rate regulator.

FIG. 5 is a schematic diagram of four types of replacement parts of the flow rate regulator. In one embodiment, as shown in FIG. 5, the flow rate regulator 5 comprises a plurality of replacement parts, such as a replacement part 5A, a replacement part 5B, a replacement part 5C, and a replacement part 5D.

The replacement part 5A, the replacement part 5B, the replacement part 5C, and the replacement part 5D are different models of flow rate regulators 5 with different radius and heights and may respectively define and form different sizes of water flow channels 20 with the channel water inlet 211. Therefore, a gap between the flow rate regulator 5 and the channel water inlet 211 is changed to finally regulate a flow rate of the flushing water. The user may replace different models of replacement parts as required to meet the user's demand for a drainage speed.

The above technical solutions may be combined as required to achieve a desired technical effect.

Figure 10:
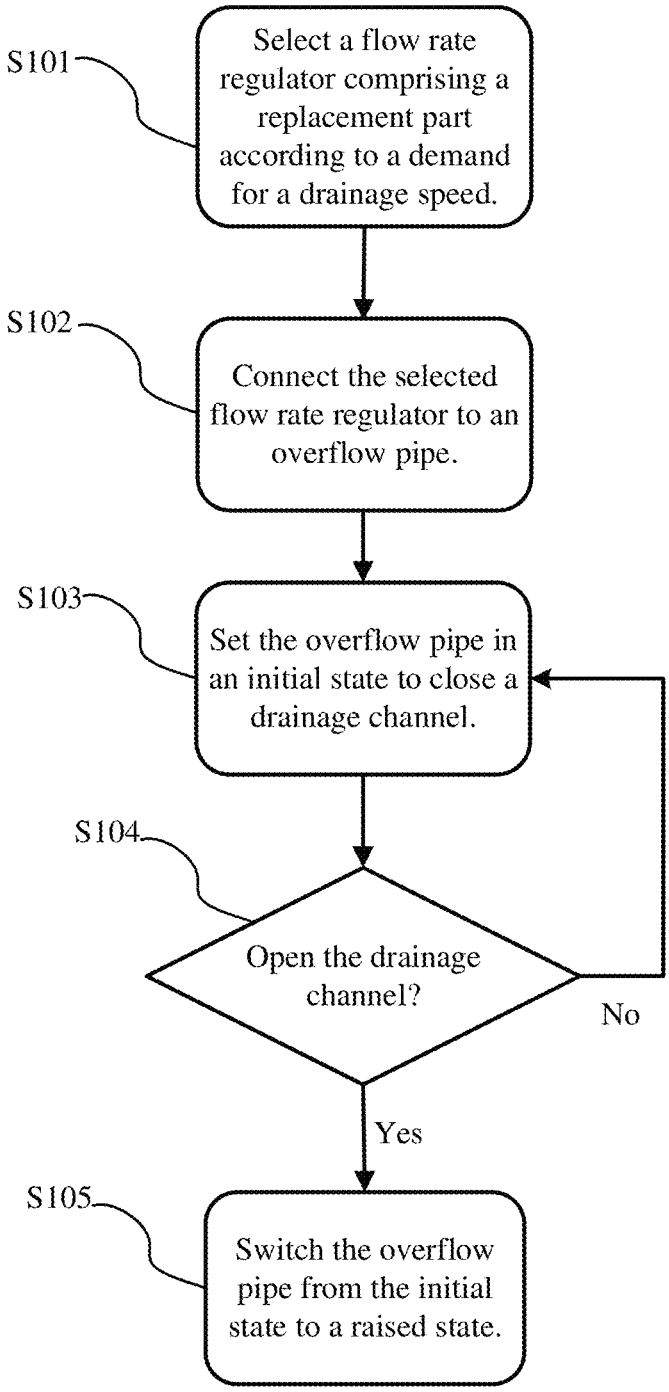
FIG. 10 is a flow chart of a method for controlling water to drain from a water tank by using a drain valve according to one embodiment of the present disclosure.

FIG. 10 is a flow chart of a method for controlling water to drain from a water tank by using a drain valve according to one embodiment of the present disclosure. The drain valve may be a valve as discussed above. The drain valve may be controlled by a processor configured to perform an operation, function, or the like as described in the present disclosure.

At act S101, a user may select a flow rate regulator 5 comprising a replacement part according to the user's demand for a drainage speed.

At act S102, the user may connect the selected flow rate regulator 5 to the overflow pipe 3. Specifically, the clamping claw 53 of the selected flow rate regulator 5 is clamped with the clamping groove 61 of the connector 6 assembled at the lower end of the overflow pipe 3.

At act S103, the processor may set the overflow pipe 3 in the initial state. Specifically, the processor may drive the overflow pipe 3 to move down relative to the valve body 1 so that the blocking element 4 seals the channel water inlet 211 of the drainage channel 21 and the flow rate regulator 5 is located in the drainage channel 21. Thus, the drainage channel 21 is closed to prevent the water in the water tank from entering the drainage channel 21.

At act S104, the processor may determine whether to open the drainage channel 21. For example, when the processor receives a flushing command from the user, the processor may determine that the drainage channel 21 should be opened.

At act S105, when the processor determines that the drainage channel 21 should be opened (Yes in S104), the processor may switch the overflow pipe 3 from the initial state to the raised state. Specifically, the processor may drive the overflow pipe 3 to move up relative to the valve body 1 so that the blocking element 4 leaves the channel water inlet 211. Therefore, the flow rate regulator 5 is partially or completely located above the channel water inlet 211, and the water flow channel 20 is formed between the flow rate regulator 5 and the channel water inlet 211. Thus, the drainage channel 21 is opened to allow the water in the water tank to enter the drainage channel 21 and then a toilet bowl.

When the processor determines that the drainage channel 21 should not be opened (No in S104), the method for controlling the water to drain from the water tank by using the drain valve returns to S103 so as to maintain the initial state of the overflow pipe 3.

The above description only illustrates the principles and the embodiments of the present disclosure. It should be pointed out that for those of ordinary skill in the art, other modifications may be made based on the principles of the present disclosure. The modifications should also be regarded as falling in the protection scope of the present disclosure.

We claim:

1. A drain valve, comprising:

a valve body;

a valve seat mounted below the valve body; and an overflow pipe located in the valve body and configured to move up and down relative to the valve body, wherein the valve seat comprises a drainage channel, wherein the overflow pipe comprises a blocking element and a flow rate regulator below the blocking element, wherein the overflow pipe is configured to be in an initial state or a raised state and configured to be switched between the initial state and the raised state, wherein when the overflow pipe is in the initial state, the blocking element seals a channel water inlet of the drainage channel, and the flow rate regulator is located in the drainage channel, wherein when the overflow pipe is in the raised state, the blocking element leaves the channel water inlet, the flow rate regulator is partially or completely located above the channel water inlet, and a water flow channel is formed between the flow rate regulator and the channel water inlet, wherein a connector is disposed at a lower end of the overflow pipe, and wherein the flow rate regulator is clamped with the connector.

2. The drain valve according to claim 1, wherein the connector comprises a clamping groove, wherein the flow rate regulator comprises a clamping claw, and wherein the clamping claw is clamped with the clamping groove.

3. The drain valve according to claim 2, wherein the clamping groove is an annular clamping groove, wherein a plurality of clamping claws are arranged on the flow rate regulator at intervals along a circumferential direction of the flow rate regulator, and wherein each of the plurality of clamping claws is clamped with the annular clamping groove.

4. The drain valve according to claim 2, wherein the flow rate regulator comprises an outer ring portion and an inner ring portion connected to the outer ring portion, wherein the clamping claw is arranged on the inner ring portion, and wherein when the overflow pipe is in the raised state, the water flow channel is formed between the outer ring portion and the channel water inlet.

5. The drain valve according to claim 4, wherein a top surface of the outer ring portion is higher than a top surface of the clamping claw, and wherein the top surface of the outer ring portion is contacted with a bottom portion of the overflow pipe.

6. The drain valve according to claim 5, wherein a top portion of the outer ring portion is higher than a top portion of the inner ring portion, wherein a bottom portion of the outer ring portion is connected to a bottom portion of the inner ring portion, and wherein the clamping claw is integrally arranged at the top portion of the inner ring portion.

7. The drain valve according to claim 4, wherein the water flow channel determines an amount of water entering the drainage channel from the channel water inlet in unit time, and wherein a size of the water flow channel is defined by a size, a shape, or a contour of the outer ring portion.

8. The drain valve according to claim 1, wherein the flow rate regulator is a rubber element.

9. The drain valve according to claim 1, wherein the blocking element is a rubber gasket.

10. The drain valve according to claim 1, wherein a sealing ring is arranged in the drainage channel.

11. The drain valve according to claim 1, wherein the flow rate regulator comprises a plurality of replacement elements.

12. A water tank of a toilet, the water tank comprising a drain valve, the drain valve comprising:

a valve body;

a valve seat mounted below the valve body; and an overflow pipe located in the valve body and configured to move up and down relative to the valve body, wherein the valve seat comprises a drainage channel, wherein the overflow pipe comprises a blocking element and a flow rate regulator below the blocking element, wherein the overflow pipe is configured to be in an initial state or a raised state and configured to be switched between the initial state and the raised state, wherein when the overflow pipe is in the initial state, the blocking element seals a channel water inlet of the drainage channel, and the flow rate regulator is located in the drainage channel, wherein when the overflow pipe is in the raised state, the blocking element leaves the channel water inlet, the flow rate regulator is partially or completely located above the channel water inlet, and a water flow channel is formed between the flow rate regulator and the channel water inlet, wherein when the water flow channel is formed, water enters a toilet bowl from the channel water inlet and the drainage channel, wherein a connector is disposed at a lower end of the overflow pipe, and wherein the flow rate regulator is clamped with the connector.

13. The water tank according to claim 12, wherein the connector comprises a clamping groove, wherein the flow rate regulator comprises a clamping claw, and wherein the clamping claw is clamped with the clamping groove.

14. The water tank according to claim 13, wherein the clamping groove is an annular clamping groove, wherein a plurality of clamping claws are arranged on the flow rate regulator at intervals along a circumferential direction of the flow rate regulator, and wherein each of the plurality of clamping claws is clamped with the annular clamping groove.

15. The water tank according to claim 13, wherein the flow rate regulator comprises an outer ring portion and an inner ring portion connected to the outer ring portion, wherein the clamping claw is arranged on the inner ring portion, and wherein when the overflow pipe is in the raised state, the water flow channel is formed between the outer ring portion and the channel water inlet.

16. The water tank according to claim 15, wherein a top surface of the outer ring portion is higher than a top surface of the clamping claw, and wherein the top surface of the outer ring portion is contacted with a bottom portion of the overflow pipe.

17. The water tank according to claim 16, wherein a top portion of the outer ring portion is higher than a top portion of the inner ring portion, wherein a bottom portion of the outer ring portion is connected to a bottom portion of the inner ring portion, wherein the clamping claw is integrally arranged at the top portion of the inner ring portion, wherein the water flow channel determines an amount of the water entering the drainage channel from the channel water inlet in unit time, and wherein a size of the water flow channel is defined by a size, a shape, or a contour of the outer ring portion.

18. A method for controlling water to drain from a water tank by using a drain valve, the method comprising:

selecting a flow rate regulator comprising a replacement part according to a demand for a drainage speed;

connecting the selected flow rate regulator to an overflow pipe of the drain valve;

setting, by a processor, the overflow pipe in an initial state by driving the overflow pipe to move down relative to a valve body of the drain valve so that a blocking element of the drain valve seals a channel water inlet of a drainage channel of the drain valve;

determining, by the processor, whether to open the drainage channel; and when determining that the drainage channel should be opened, switching, by the processor, the overflow pipe from the initial state to a raised state so that the blocking element leaves the channel water inlet, the selected flow rate regulator is partially or completely located above the channel water inlet, and a water flow channel is formed between the selected flow rate regulator and the channel water inlet, wherein connecting the selected flow rate regulator to the overflow pipe of the drain valve comprises:

clamping the selected flow rate regulator with a connector disposed at a lower end of the overflow pipe.

* * * * *